US005141047A

United States Patent [19]

Geoffroy

[11] Patent Number: 5,141,047

[45] Date of Patent: Aug. 25, 1992

[54] FLUIDIZED BED HEAT EXCHANGER

[75] Inventor: David R. Geoffroy, Holden, Mass.

[73] Assignee: Riley Stoker Corporation, Worcester, Mass.

[21] Appl. No.: 663,574

[22] Filed: Mar. 1, 1991

[51] Int. Cl.[5] ..... F28C 3/16

[52] U.S. Cl. ..... 165/104.16; 122/4 D; 34/57 A

[58] Field of Search ..... 165/104.16; 122/4 D; 34/52 A

[56] References Cited

U.S. PATENT DOCUMENTS

| | | | |
|---|---|---|---|
| 2,697,653 | 12/1954 | Nicholson . | |
| 2,702,742 | 2/1955 | Hillard, Jr. | 34/57 A |
| 3,736,908 | 6/1973 | Ehrlich et al. | 122/4 D |
| 3,763,830 | 10/1973 | Robison | 122/4 D |
| 4,312,135 | 1/1982 | Devanney | 122/4 D |
| 4,313,398 | 2/1982 | Ostendorf . | |
| 4,340,400 | 7/1982 | Campanile et al. . | |
| 4,427,053 | 1/1984 | Klaren . | |
| 4,454,838 | 6/1984 | Strohmeyer, Jr. . | |
| 4,499,944 | 2/1985 | Komakine . | |
| 4,539,939 | 9/1985 | Johnson . | |
| 4,567,940 | 2/1986 | Klaren . | |
| 4,655,147 | 4/1987 | Brännström et al. . | |

*Primary Examiner*—Albert W. Davis, Jr.

*Attorney, Agent, or Firm*—Mason, Kolehmainen, Rathburn & Wyss

[57] ABSTRACT

A vertical tube heat exchanger for use with fluidized solid particulates as a heat transfer medium includes a plurality of vertically extending spaced apart tubes for containing an internal fluid flowing in heat transfer relationship with the walls of the tube. A containment housing is provided around the tubes for containing a flow of fluidized solid particulates moving through a heat exchange chamber in the housing around the exterior surface of the tubes. A gas plenum chamber is provided adjacent a lower end of the containment housing for directing fluidizing gas into the solid particulates. The housing includes a dividing floor between an upper heat exchange chamber and a lower plenum chamber and the floor is formed with openings in concentric alignment with the vertical tubes for injecting fluidizing gas into the heat exchange chamber around the tubes to flow upwardly into a bed of solid particulates. A bubble cap is provided around each tube for preventing the solid particulates from passing into the plenum chamber while at the same time permitting the injected fluidizing gas to flow upwardly into the heat exchange chamber. The bubble caps also accommodate relative expansion and contraction between the tubes and the floor of the housing to prevent a build up of stress between these components.

10 Claims, 2 Drawing Sheets

FLUIDIZED BED HEAT EXCHANGER

BACKGROUND OF THE INVENTION

1. Field of the Invention

The present invention relates to heat exchangers and, more particularly, to vertical tube heat exchangers for use with fluidized solid particulates as a heat transfer medium The vertical tube heat exchanger of the present invention is especially well adapted for use in fluidized bed type steam and generating systems wherein fluidized solids are circulated as a heat transfer medium.

2. Background of the Prior Art

The following U.S. patents disclose steam generating systems and heat exchangers using fluidized bed solids as a heat transfer medium: Nicholson U.S. Pat. No. 2,697,653; Ostendorf U.S. Pat. No. 4,313,398; Campanile et al. U.S. Pat. No. 4,340,400; Klaren U.S. Pat. No. 4,427,053; Strohmeyer, Jr. U.S. Pat. No. 4,454,838; Komakine U.S. Pat. No. 4,499,944; Johnson U.S. Pat. No. 4,539,939; Klaren U.S. Pat. No. 4,567,940 and Brannstrom et al. U.S. Pat. No. 4,655,147.

One of the problems associated with fluidized bed heat exchange devices and systems, stems from the fact that fluidizing air must be introduced into a fluidized bed of solids from a lower or floor level and the temperature differentials between the floor material and the relatively cooler, fluid-filled tubes causes relative motion which must be accommodated without leakage of the solids into the plenum chamber or gas supply duct beneath the floor.

OBJECTS OF THE INVENTION

It is an object of the present invention to provide a new and improved heat exchanger of the character described employing vertical fluid tubes which pass through openings provided in a floor separating a fluidized solids bed heat exchanging chamber above a lower gas containing plenum chamber.

More particularly, it is an object of the present invention to provide a new and improved vertical tube type heat exchanger of the character described having a novel bubble cap arrangement for accommodating relative expansion and contraction between a floor provided between a heat exchange chamber and a gas plenum chamber and cooler, fluid containing tubes which pass through openings in the floor into the heat exchange chamber.

More particularly, it is an object of the present invention to provide a heat exchanger of the type described wherein temperature differentials between floor material and fluid-filled tubes are accommodated in a bubble cap system which permits relative motion and, at the same time, permits the passage of fluidizing gas upwardly into a heat exchange chamber but prevents fluidized solids from passing downwardly into a gas plenum chamber therebelow.

BRIEF SUMMARY OF THE PRESENT INVENTION

The foregoing and other objects of the present invention are accomplished in a new and improved vertical tube heat exchanger utilizing fluidized solid particulates as a heat exchange heat transfer medium. The heat exchanger includes a plurality of vertically extending, fluid-filled spaced apart tubes containing an internal fluid-flow in heat transfer relationship with the walls of the tube. A containment housing is provided around the tubes for containing a flowing bed of fluidized solid particulates moving in heat exchange relationship with the tubes. A gas plenum chamber is provided adjacent a lower end of the housing for supplying gaseous fluid to be injected upwardly into the solids bed to fluidize the solid particulate material to facilitate movement of the solids through the heat exchange chamber around the tubes. The housing includes a dividing wall or floor between the heat exchange chamber and the plenum chamber formed with openings in concentric alignment with the tubes and larger in size for injecting fluidizing gas from the lower gas plenum chamber upwardly into the solids bed. Bubble cap units are provided around the tubes for preventing the flow of solid particulates downwardly from the heat exchange chamber into the gas plenum chamber while permitting the upward flow of fluidizing gas and also permitting relative movement between the dividing wall or floor and the cooler, fluid-flow containing tubes.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE PRESENT INVENTION

Figure 1:
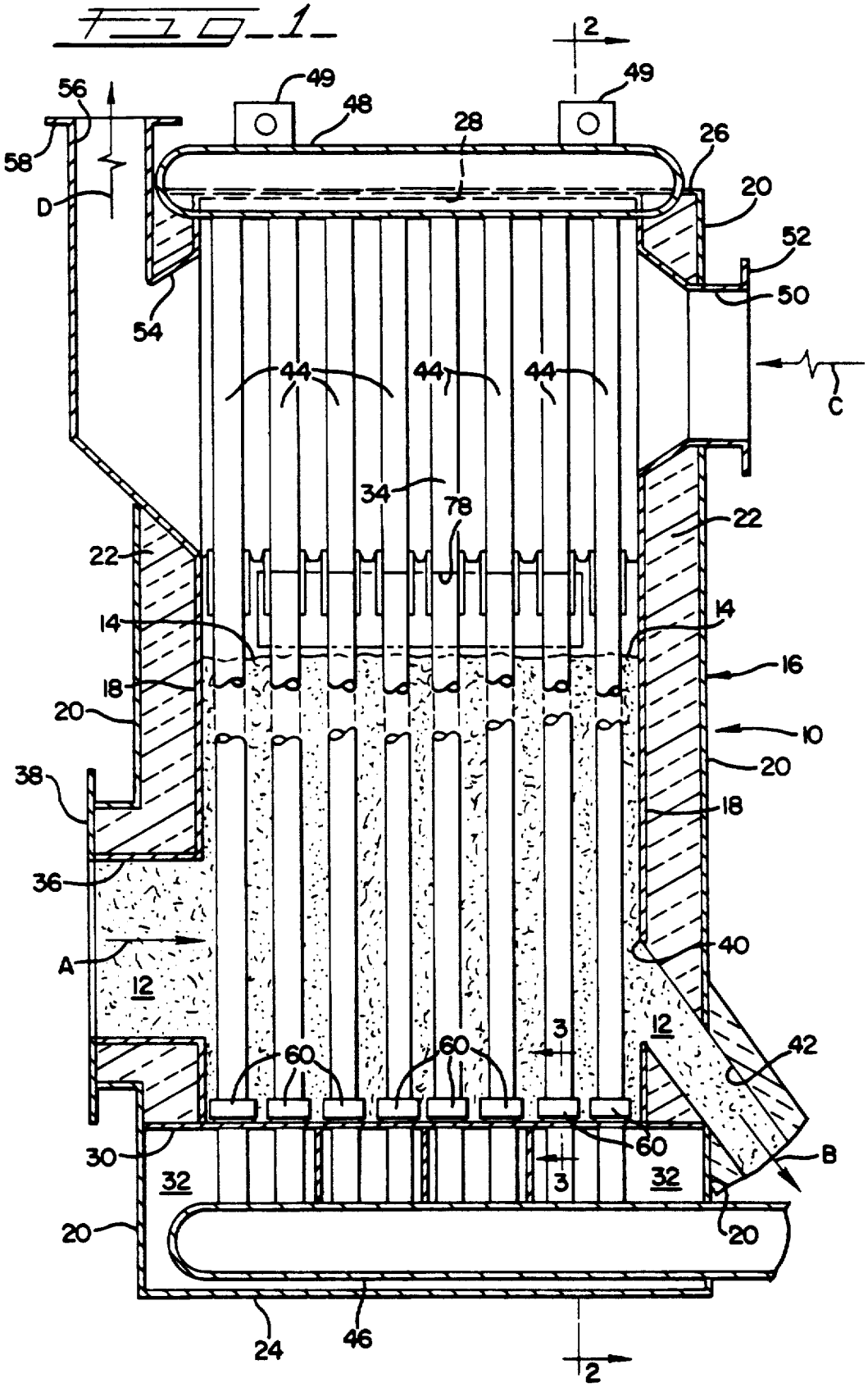
FIG. 1 is a vertical cross-sectional view of a new and improved heat exchanger constructed in accordance with the features of the present invention and adapted to use fluidized solid particulates as a heat transfer medium.

Referring now more particularly to the drawings, therein is illustrated a new and improved vertical tube type heat exchanger 10 designed to use fluidized solid particulates 12 as a heat transfer medium in a fluidized bed 14 contained within an upstanding insulated housing generally indicated by the reference numeral 16. The housing 16 includes pairs of inner and outer vertical side walls 18 and 20, respectively, separated from one another by a space containing high quality, heat insulating material 22.

Figure 2:
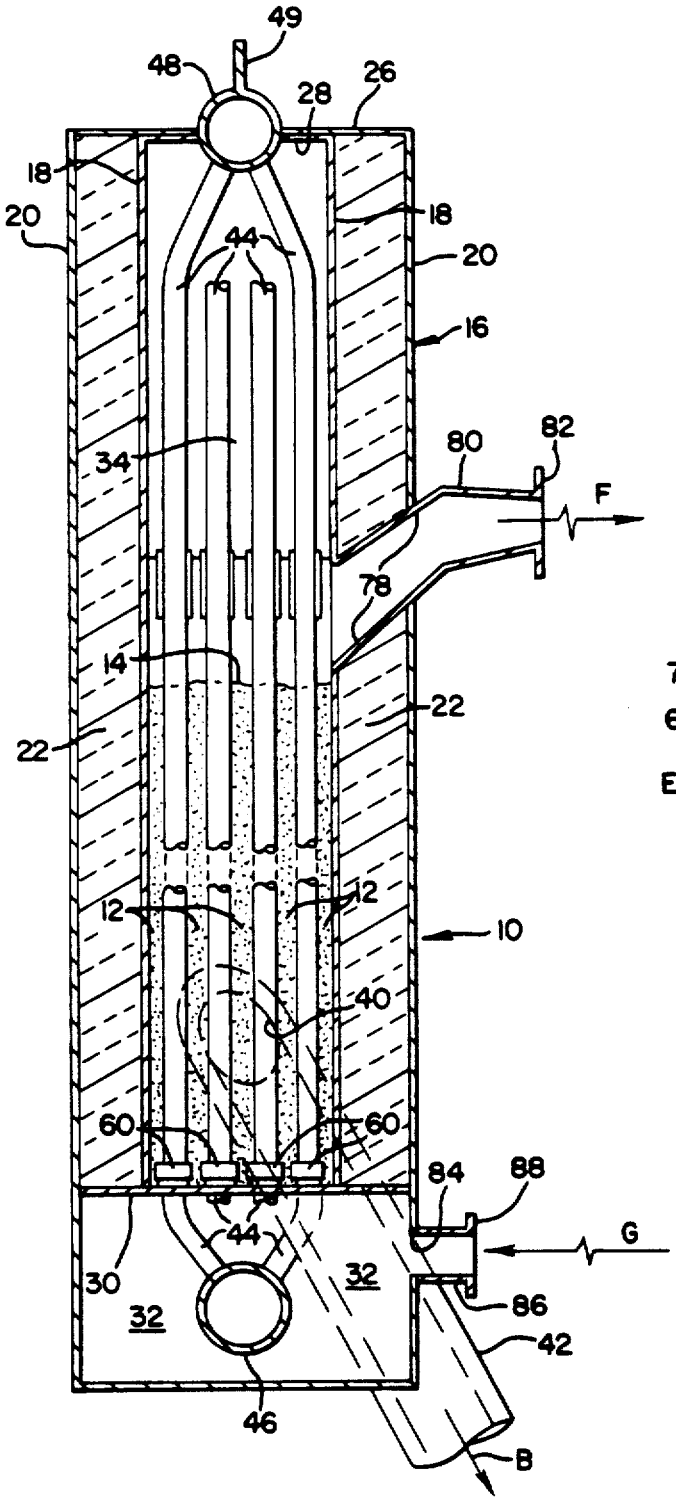
FIG. 2 is a transverse cross-sectional view of the heat exchanger taken substantially along lines 2—2 of FIG. 1.

At the lower end, the housing 16 is provided with a bottom wall 24 and at the upper end a top wall 26 is joined to the outer side walls 20. As best shown in FIG. 2, upper ends of the inner side walls 18 are joined to an inner top wall 28 and at an intermediate level above the bottom wall 24, the housing 16 is provided with a dividing wall 30 which separates the interior of the housing 60 into a lower gas plenum chamber 32 and an upper, heat exchange chamber 36 which contains the fluidized solids bed 14 in a lower half portion thereof above the floor 30 of the plenum chamber.

As viewed in FIG. 1, a flow of solid particulates 12 is introduced into the fluidized bed 14 in the lower portion of the heat exchange chamber 34 through an inlet opening 36 having an outer flange 38 and adapted to contain a flow of solid particulates moving from left to right as indicated by the arrow "A". On an opposite side, the housing 16 is provided with a discharge or outlet opening 40 and an insulated outlet discharge duct 42 is connected to the outlet opening 40 to contain a downward flow of solid particulates 12 as indicated by the arrow "B" (FIG. 1).

In accordance with the present invention, the vertical tube heat exchanger 10 is provided with a bank of vertically extending fluid tubes 44 containing gas and/or liquid such as steam and water to be heated. The fluid moves upwardly in the tubes from an elongated lower supply header 46 mounted in the plenum chamber 32 and upper ends of the tubes are connected to an upper header tank 48 at the center of the top walls 26 and 28 of the housing 16 as best shown in FIG. 2.

The header tank 48 includes a pair of centrally aligned. upstanding support brackets 49 which can be used for hanging the entire heat exchanger 10 from a structural member (not shown). The brackets 49 support the upper header tank 48, lower header 46 and the bank of tubes 44 independently of lower portions of the housing 16 and other components in the lower end portion therein. Water, steam and/or a mixture thereof enters into the system through the lower supply header 46 and passes upwardly through the spaced apart fluid tubes 44 for heat absorption through the tube walls. The heated fluid from the tubes 44 eventually moves into the upper collection header 48 for distribution to other components remote therefrom. As the fluid moves upwardly in the tubes 44 in heat transfer relationship with the wall surfaces thereof, heat is picked up from the hot fluidized solids 12 in the fluid solids bed 14, thus raising the temperature of the water, steam and/or mixture of fluid as it rises in the tubes.

Heat may be extracted from the tubes or further heating of the fluids flowing in the tubes may be obtained in an upper portion of the heat exchange chamber 34 of the housing 16 which is relatively open above the upper level of the fluidized solids bed 14. For this purpose, an inlet fitting 50 with a flange on the outer end is provided on the right hand side wall structure as viewed in FIG. 1 to accommodate the inward flow of gaseous fluids as indicated by the arrow "C". This gaseous fluid flows across the matrix of tubes 44 and, depending upon the relative temperatures, may pick up or discharge heat to the inner fluids flowing in the interior of the tubes 44. Eventually, the gases entering the upper portion of the heat exchange chamber 34 pass outwardly through an outlet opening 54 on the left hand wall structure of the housing 16 as viewed in FIG. 1 and eventually flow upwardly via an outlet fitting 56 having a flange 58 at the upper end and as indicated by the arrow "D".

Figure 3:
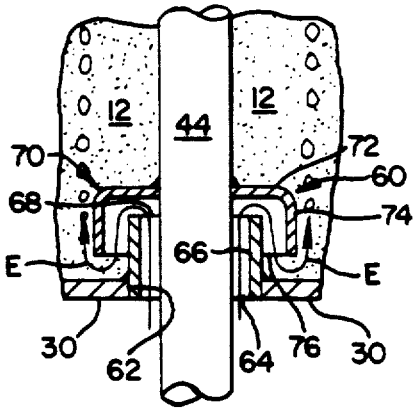
FIG. 3 is an enlarged fragmentary vertical cross-sectional view taken substantially along lines 3—3 of FIG. 1.

In accordance with the present invention, each of the fluid tubes 44 is provided with a bubble cap assembly 60 in concentric alignment with and at a level adjacent the housing divider wall or floor 30. The bubble cap assemblies 60 serve to permit fluidizing gas from the lower plenum chamber 32 to be injected upwardly into the bed 14 of fluidized solid particulates 1 2 contained in the lower portion of the heat exchange chamber 34. As best shown in FIG. 3, the floor or dividing wall 30 which separates the plenum chamber 32 from the heat exchange chamber 34 is formed with a plurality of circular openings 62 concentrically disposed with a vertical tube 44.

As illustrated in FIG. 3, the circular openings 62 are somewhat larger in diameter than the outer diameter (O.D.) of the tubes 44 in order to form an annular air passage 64 around each tube for the injection of gas from the plenum chamber 32 upwardly into the solids bed 14 as illustrated by the arrows "E". In order to prevent solid particulates 12 in the bed 14 from passing downwardly into the plenum chamber 32 at any time and when the plenum chamber is depressurized and not supplied with fluidizing gas, each opening 62 is provided with an upstanding inner cylindrical tube section 66 secured to the floor 30 by welding or the like and terminating at an upper level 68 spaced downwardly of the underside of a radial, upper wall 72 of a bubble cap 70. The annular upper wall 72 is secured to the tube 44 by welding or other means and extends radially outward thereof at a level spaced above the upper end 68 of the inner tube member 66. The bubble cap also includes a downwardly depending, outer skirt wall 74. Preferably the outer skirt wall 74 and the radial wall 72 of the bubble cap 70 are integrally joined in one piece as illustrated in FIG. 3. The outer skirt wall has a lower end 76 spaced at a level well below the upper end 68 of the inner tube 66 so as to provide a tortuous path for the injection gas moving upwardly as indicated by the arrow "E". In addition, the lower edge 76 of the outer annular skirt 74 provides a dam, which in cooperation with the inner tube member 66 prevents solid particulates 12 from flowing into the plenum chamber 32 around each tube 44 through the openings 62, especially when injection gas is not present during periods of shutdown or the like. Normally, during operation, the presence of high velocity fluidizing gas in the bubble caps 60 helps to prevent the downward flow of any of the solid particulates 12 into the plenum chamber 32.

Injected fluidizing gas from the lower plenum chamber 32 moves upwardly around the individual tubes 44 and fluidizes the solid particulates 12 so that they can float or slide and move laterally or horizontally around the tubes to transfer heat to the steam and/or water flowing upwardly in the interior of the tubes. Because the tubes 44 are normally cooled from the interior by the water and/or steam moving therethrough, a considerably lower temperature is normally obtained in the metal of the tubes 44 than is present in the surrounding walls 18 and divider wall or floor 30 of the heat exchanger 10.

The differential in temperature between the tubes 44 and the floor 30 and walls 18 varies between high operating ranges and low operating ranges and these differences tend to cause great divergence in the amount of relative contraction and expansion between the tubes 44 and the floor 30. If the tubes 44 were welded to the floor 30, stresses would tend to build up because of differential thermal expansion and contraction during operation and during periods of shut down. However, these stresses do not develop because the bubble caps 60 permit the tubes 44 to float relative to the openings 62 in the floor 30 and the surrounding walls 18 of the housing 16 so that few, if any, relative expansion and contraction stress are built up between these components because of differential thermal expansion and contraction.

The bubble caps 60 thus provide a dual function of injecting fluidizing gas while preventing a reverse flow of solid particulates 12 and also provide a means for accommodating differential expansion and contraction between the normally cooler, elongated fluid containing vertical tubes 44 and the hot floor 30 at the regions where the tubes pass through the openings 62 in the floor 30.

At a level above the solids bed 14, the side walls 18 and 20 on at least one side of the housing 16 are provided with a rectangular discharge opening 78 so that fluidizing gas reaching the upper level of the solids bed 14 can pass readily out of the housing 16 through a separate fluidizing gas outlet duct 80 having a flange 82 at the outer end as indicated by the arrow "F" in FIG. 2.

Initially, fluidizing gas such as air is supplied to the plenum chamber 32 through an inlet opening 84 and inlet duct 86 having a flange 88 at the outer end as indicated by the arrow "G", FIG. 2. Generally, the fluidizing gas is under pressure from a fan or blower (not shown) so that when the heat exchanger 10 is in operation, the plenum chamber 32 is pressurized.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A vertical tube heat exchanger using fluidized solid particulates as a heat transfer media, comprising:

a plurality of vertically extending spaced apart tubes for containing an internal fluid flowing in a heat transfer relationship with walls of said tubes;

a housing around said tubes for containing a flow of said fluidized solid particulates moving in a heat exchange chamber in heat transfer relationship surrounding said walls of said tubes;

a plenum chamber adjacent a lower end for supplying gaseous fluid for fluidizing said solid particulates to move through said heat exchange chamber;

said housing including a dividing floor between said heat exchange chamber and said plenum chamber formed with an opening in concentric alignment with at least one of said tubes for injecting fluidizing gas into a space around said tubes; and bubble cap means around said tube for preventing the flow of solid particulates from said heat exchange chamber to said plenum chamber while permitting the injection of said fluidizing gas.

2. The heat exchanger of claim 1, wherein:

said bubble cap means includes annular top wall means secured on said tube having a downwardly extending outer skirt wall means depending from an outer edge of said top wall means spaced outwardly of said tube and an inner skirt wall means projecting upwardly from said floor around said opening between said tube and said outer skirt wall means.

3. The heat exchanger of claim 2, wherein:

said outer skirt wall means has a lower edge spaced above said floor.

4. The heat exchanger of claim 3, wherein:

said inner skirt wall means has an upper edge spaced above said lower edge of said outer skirt wall means below said top wall means.

5. The heat exchanger of claim 2, wherein:

said floor includes an opening for each of said tubes having an inner edge spaced apart from an outer surface of said tubes to form an annular passage for injecting fluidizing gas into heat exchange chambers around each tube.

6. The heat exchanger of claim 5, including:

bubble cap means around each of said tubes in said heat exchange chamber.

7. The heat exchanger of claim 6, including:

fluid supply header means in said plenum chamber for supplying fluid to said tubes.

8. The heat exchanger of claim 7, including:

fluid collecting header means adjacent an upper end of said heat exchange chamber for receiving fluid from said tubes.

9. The heat exchanger of claim 8, including:

inlet means for supplying said solid particulates to said heat exchange chamber of said housing.

10. The heat exchanger of claim 9, including:

outlet means for discharging said solid particulates from said heat exchange chamber of said housing.

* * * * *